US011779833B1

(12) United States Patent
Teel

(10) Patent No.: US 11,779,833 B1
(45) Date of Patent: Oct. 10, 2023

(54) INTERACTIVE ELECTRONIC PUZZLE GAME DEVICE

(71) Applicant: Peter Ellis Teel, Crestline, CA (US)

(72) Inventor: Peter Ellis Teel, Crestline, CA (US)

( * ) Notice: Subject to any disclaimer, the term of this patent is extended or adjusted under 35 U.S.C. 154(b) by 76 days.

(21) Appl. No.: 17/674,942

(22) Filed: Feb. 18, 2022

(51) Int. Cl.
*A63F 9/08* (2006.01)
*A63F 9/06* (2006.01)
*A63F 9/24* (2006.01)

(52) U.S. Cl.
CPC ..... *A63F 9/0826* (2013.01); *A63F 9/0612* (2013.01); *A63F 9/24* (2013.01); *A63F 2009/0846* (2013.01); *A63F 2009/241* (2013.01); *A63F 2009/2447* (2013.01); *A63F 2009/2454* (2013.01); *A63F 2009/2458* (2013.01)

(58) Field of Classification Search
CPC ..... A63F 9/0826; A63F 9/0612; A63F 9/24; A63F 2009/0846; A63F 2009/241; A63F 2009/2447; A63F 2009/2454; A63F 2009/2458
USPC ..... 273/146, 7
See application file for complete search history.

(56) References Cited

U.S. PATENT DOCUMENTS 4,378,116 A 3/1983 Rubik
4,575,087 A 3/1986 Sinclair
4,809,979 A 3/1989 Skowronski et al.
4,957,291 A 9/1990 Miffit et al.
5,417,425 A * 5/1995 Blumberg ..... A63F 9/0612 273/153 R
5,564,702 A 10/1996 Meffert
5,573,245 A * 11/1996 Weiner ..... A63F 9/0612 273/153 R
5,603,500 A * 2/1997 Olti ..... A63F 9/0612 273/153 R
5,992,849 A * 11/1999 Olti ..... A63F 13/92 463/9

(Continued)

FOREIGN PATENT DOCUMENTS

GB 2225246 B1 5/1990
JP 2008307084 B1 12/2008
WO 2008/131613 A1 11/2008

OTHER PUBLICATIONS

Corinne Iozzio and Amber Williams, The 10 Best Toys From Toy Fair 2013, Popular Science, Feb. 13, 2013, see section "ThinkGeek Princip Interactive LED Futuro Cube", as published online https://www.popsci.com/technology/article/2013-02/10-best-toys-toy-fair-2013/.

*Primary Examiner* — Pierre E Elisca

(57) ABSTRACT

One embodiment of a puzzle device comprising a current puzzle state represented by a modulo-M number of N digits, a set of N indicators each capable of indicating one digit of the current puzzle state, an array of N arithmetic and/or logical operations with each operation in the array corresponding to one of said set of indicators, and a control means of selecting one of said set of N indicators. When one of said set of N indicators is selected, its corresponding operation in the array of arithmetic and/or logical operations is selected, applied to the current puzzle state's modulo-M number of N digits, and the new current puzzle state indicated by said set of N indicators. The puzzle game may be played on a dedicated device or as part of a video game on a computer, mobile phone, or game console. Other embodiments are described and shown.

19 Claims, 9 Drawing Sheets

(56) References Cited

U.S. PATENT DOCUMENTS

| | | | | |
|---|---|---|---|---|
| 7,862,415 | B1 * | 1/2011 | Ghaly | A63F 9/0803 463/9 |
| 8,876,585 | B1 * | 11/2014 | Ghaly | A63F 9/24 463/9 |
| 2005/0079477 | A1 * | 4/2005 | Diesel | H04L 67/01 434/350 |

* cited by examiner

INTERACTIVE ELECTRONIC PUZZLE GAME DEVICE

CROSS-REFERENCE TO RELATED APPLICATIONS

This application claims the benefit of provisional patent application Ser. No. 63/151,652, filed 2021 Feb. 20 by the present inventor.

FEDERALLY SPONSORED RESEARCH

Not Applicable

SEQUENCE LISTING OR PROGRAM

Not Applicable

BACKGROUND—TECHNICAL FIELD

The present invention relates to an electronic game device and the software for a puzzle game to be played on this device.

BACKGROUND—PRIOR ART

The following is a tabulation of some prior art that presently appears relevant:

| U.S. Pat. No. | | | |
|---|---|---|---|
| Pat. No. | Kind Code | Issue Date | Patentee |
| D256,139 | B1 | 1980 Jul. 29 | Venditti et al. |
| 4,378,116 | B1 | 1983 Mar. 29 | Rubik |
| 4,575,087 | B1 | 1986 Mar. 11 | Sinclair |
| 4,809,979 | B1 | 1989 Mar. 07 | Skowronski et al. |
| 4,957,291 | B1 | 1990 Sep. 18 | Miffit et al. |
| 5,564,702 | B1 | 1996 Oct. 15 | Meffert |
| 5,573,245 | B1 | 1996 Nov. 12 | Weiner et al. |

| Foreign Patent Documents | | | | |
|---|---|---|---|---|
| Doc. Nr. | Country | Kind Code | Pub. Date | App or Patentee |
| 2225246 | GB | B1 | 1990 May 30 | Monticolombi et al. |
| 2008/131613 | WO | A1 | 2008 Nov. 06 | Hsieh |
| 2008307084 | JP | B1 | 2008 Dec. 25 | Matsumoto |

Handheld puzzle games are widely available and have been in various forms for centuries. Modern consumers of such puzzle games routinely seek out products which offer a portable form factor, a novel logic puzzle, a large number of game play levels of increasing difficulty, a spatial three-dimensional aspect, a straightforward path to puzzle mastery, a colorful and aesthetically pleasing form factor, and an inexpensive price.

Perhaps no product is more illustrative of this genre than the Rubik's Cube, U.S. Pat. No. 4,378,116 to Rubik (1983). Though purely mechanical in its original form, this invention's combination of manipulation in three dimensions, the use of a simple geometric form (a cube), and the objective of matching colors to complete the puzzle would become mainstays of the genre in the years following its invention. However, though challenging to the novice, this puzzle would quickly prove no challenge to experienced players. A quality often sought out by players is that a puzzle's challenge hold up for repeat play, so experienced players tired quickly of this purely mechanical device, and the "Rubik's Craze" of the 1980's ended as quickly as it began.

Separately, around the same time, the advent of the microprocessor in the 1970's led to the development of new electronic puzzles that promised the ability to give greater variety and depth of challenge to puzzle consumers. These electronic products also often adopted such color/pattern matching as the Rubik's Cube, but added the ability to control lights and offer multiple games and/or skill levels. Notable among these new digitally controlled games was Merlin, released by Parker Brothers, U.S. Design Pat. D256,139 to Venditti et al. (1980). This product included a matrix of 3×3 illuminated push buttons and six different games, including a novel game known as "Magic Square" in which pressing a given button would invert the state of its light (on or off) as well as the proximal lights in each cardinal direction, with the goal of achieving a specific pattern. This product was inexpensive to manufacture with multiple novel games included. However, its two-dimensional nonspatial game-play and limited 3×3 play area are generally no longer found to be captivating by the modern puzzle player.

In the years since, many inventors have used electronics to enhance the Rubik's Cube—for example, W.O. application 2008/131613 to Hsieh (2008), and Japan patent 2008307084A to Matsumoto (2008). Common elements of these proposed inventions include lights for each face segment (typically 9 multi-color LEDs per side, 54 total) with microprocessor control, as well as some electronic input means. However, such improvements still typically keep the original game-play of the Rubik's cube, and again do not provide any novel challenge to the experienced player. Additionally, the large number of LEDs and associated microprocessor connections necessitate these inventions to be complex and expensive to manufacture. These drawbacks typically limit these types of products to a niche market of Rubik's enthusiasts.

In addition to incremental improvements to the Rubik's cube, novel electronic 3-dimensional spatial puzzles have also continued to be created. A notable early work, U.S. Pat. No. 4,575,087 to Sinclair (1986) combined orientation detection with lighting up individual sides of a cube as part of the puzzle's game play. To improve on the limited challenge of Sinclair's invention, later works would add additional lights and input means to increase the variety and difficulty of their puzzles, such as U.K. patent 2,225,246 to Monticolombi and Norris (1990) and U.S. Pat. No. 4,809,979 to Skowronski et al. (1989), U.S. Pat. No. 4,957,291 to Miffit et al. (1990), U.S. Pat. No. 5,573,245 to Weiner et al. (1996), and U.S. Pat. No. 5,564,702 to Meffert (1996).

Common elements of many such novel 3D puzzles include the goal of making all lights the same color or state, various rules and/or levels of difficulty based on microprocessor control, and the use of push buttons or changes in the device's attitude as inputs used to solve the puzzle. The plethora of these games, many of which became commercially successful products, points to the ongoing popularity of such 3D puzzles as well as the need for novel challenges for puzzle enthusiasts. However, in addition to the logic problems for these aforementioned puzzles no longer being new and original for consumers, the prior art heretofore known have failed to successfully combine all of these aspects:

(a) A novel logic problem of significant challenge for enthusiasts, but with a straightforward path to eventual mastery (a balance greatly sought after by consumers);

(b) A logic problem that is also easily extendable to provide a large number of skill levels for the player (and thus greatly increase the amount of time it may hold a player's attention) while keeping the research and development costs to create such additional skill levels low;

(c) A puzzle logic problem which may provide the challenge and skill levels described in (a) and (b) in a cube shape that is preferred by customers due to its portable and attractive form factor, as well as its association with the iconic Rubik's Cube;

(d) A low manufacturing cost due to the simplicity of assembling a cube shape and reduced number of indicators (6 LEDs for the cube) versus more complex shapes such as spheres, tetrahedrons, dodecahedrons, etc.

(e) The use of blended multi-color illumination as the primary indication means of the puzzle's state, a feature which greatly improves the aesthetic appearance of the puzzle while also providing a color-based indication familiar from the Rubik's Cube.

SUMMARY

In accordance with one embodiment, a three-dimensional puzzle of N sides, where N is at least 4, is provided. The puzzle contains (a) a means of visually indicating M states on each of the N sides, where M is at least 2; (b) an input means by which to change the state of a specific side; (c) a modular arithmetic or logical operation to be applied to the state of some or all N sides on user input; and (d) a means of changing the indication of puzzle state on the changed side and/or other side(s) of the puzzle based on the arithmetic or logical operation.

BRIEF DESCRIPTION OF THE DRAWINGS

In the drawings, closely related figures have the same number but different alphabetic suffixes.

DRAWINGS—REFERENCE NUMERALS

Figure 1A:
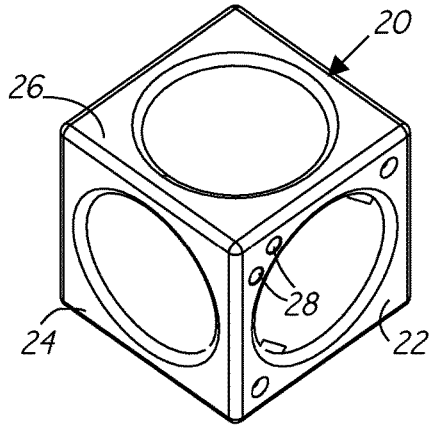
FIGS. 1A and 1B show a perspective view of both sides of a puzzle device with faces labeled in accordance with one embodiment.

20 Game device
22 Side of the game device recognized in game logic as side 0, and in assembly as the base face
24 Side of the game device recognized in game logic as side 1, and in assembly as a side face
26 Side of the game device recognized in game logic as side 2, and in assembly as a side face
28 Target disc contacts for charging
30 Side of the game device recognized in game logic as side 3, and in assembly as the top face
32 Side of the game device recognized in game logic as side 4, and in assembly as a side face
34 Side of the game device recognized in game logic as side 5, and in assembly as a side face
36 Outer lid of cube structure
38A and 38B Clear panels with etching for edge-lighting of top and bottom faces
40 Top Printed Circuit Board Assembly (PCBA)
41 7-pin 1.25 mm pitch harness with connector on two sides
42A through 42D Clear panels with etching for edge-lighting of side faces
44 Inner mounting frame
45 Lithium Polymer (Li-Po) rechargeable battery assembly
46 2-pin 2 mm pitch PCB header for rechargeable battery
47 Lithium-Polymer (Li-Po) rechargeable battery
48 Base Printed Circuit Board Assembly (PCBA)
49 2-pin 2 mm pitch harness with connector on one side
50 Outer sleeve of cube structure
52A and 52B Side-view multi-color LED to light top and base faces
54A through 54D Top-view multi-color LED to light side faces
56 LED driver Integrated Circuit (IC)
58A and 58B 7-pin 1.25 mm pitch PCB headers for connecting Top PCB to Base PCB
60 Accelerometer Printed Circuit Board Assembly (PCBA)
62 Lithium battery and charger system
63 Power management system
64 Microcontroller Integrated Circuit (IC)
66 Circular etched pattern to be lit up upon edge-lighting panels
68 Charging and display base for game device
70 USB-B Micro connector power inlet71 USB-B Micro end of cable assembly
72 Pogo-pin contacts for charging
73 USB-A end of cable assembly
74 Top housing of charging and display base
75 USB-A to micro B cable assembly

76 Base plate of charging and display base
78 USB-B micro connector mounting area

DETAILED DESCRIPTION—FIRST EMBODIMENT

Game Device—FIGS. 1-6

Figure 1B:
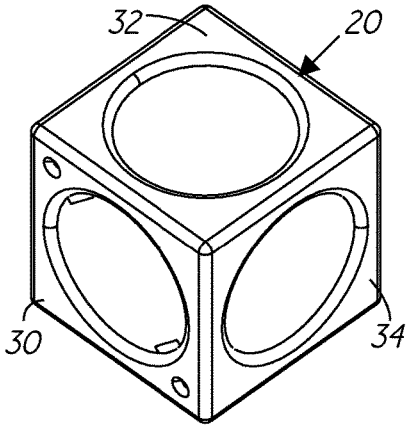

One embodiment of the game device 20 is illustrated in two perspective views in FIGS. 1A and 1B. Game device 20 externally presents as a cube-shaped assembly, consisting of 6 game sides for the user:

- a side of the game device recognized in game logic as side 0, and in assembly as the base face 22;
- a side of the game device recognized in game logic as side 1, and in assembly as a side face 24;
- a side of the game device recognized in game logic as side 2, and in assembly as a side face 26;
- a side of the game device recognized in game logic as side 3, and in assembly as the top face 30;
- a side of the game device recognized in game logic as side 4, and in assembly as a side face 32; and
- a side of the game device recognized in game logic as side 5, and in assembly as a side face 34, as well as target disc contacts 28 used for charging.

Figure 2:
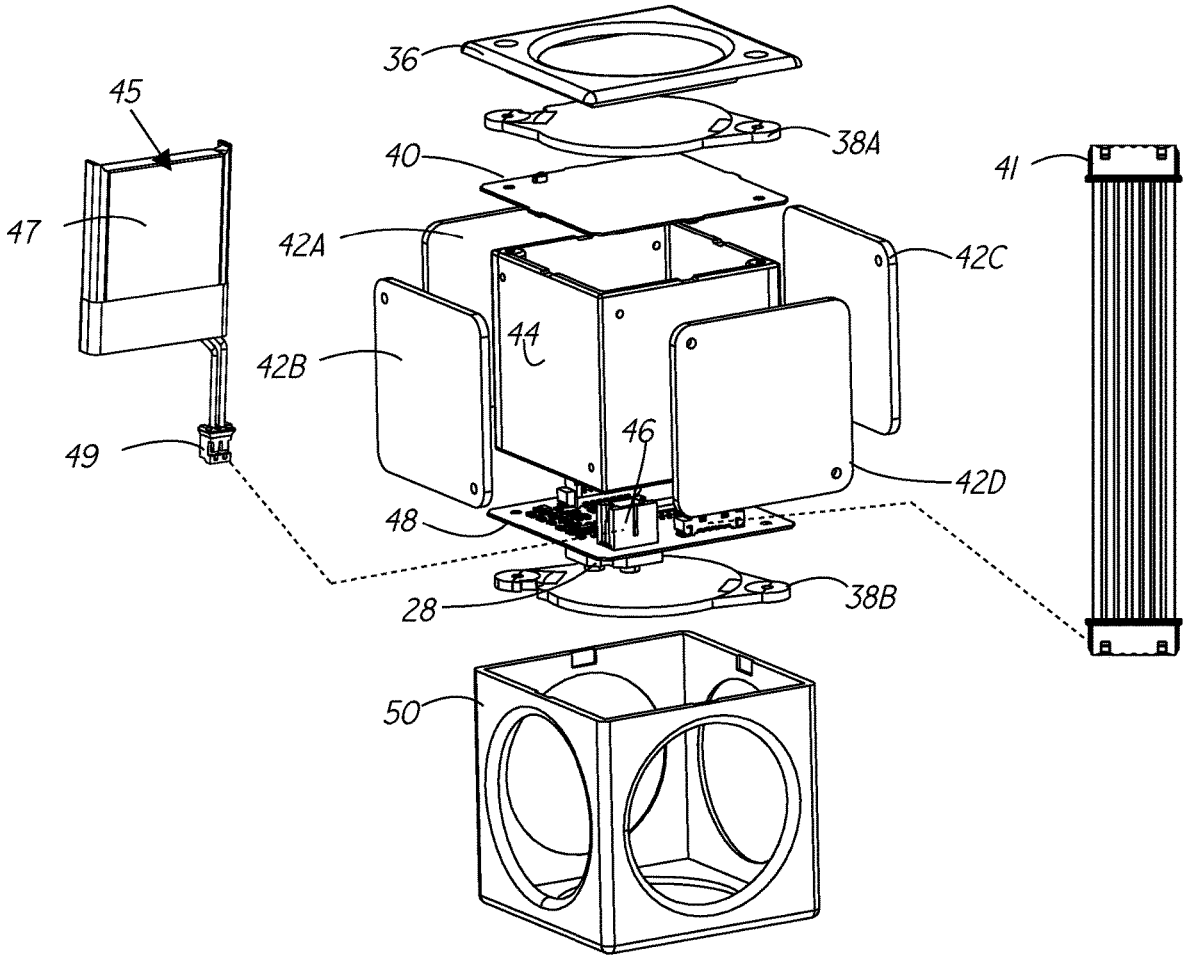
FIG. 2 is an exploded view of the puzzle device of FIG. 1A.
Figure 3A:
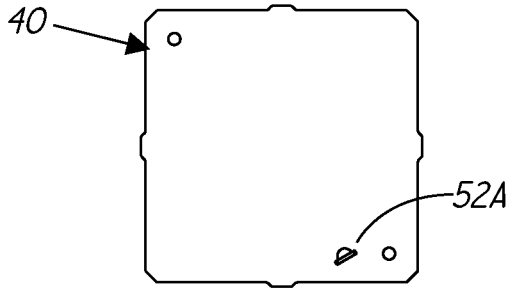
FIGS. 3A and 3B show both sides of the top PCB assembly (PCBA) of the puzzle device of FIG. 1A with assembled parts labeled.
Figure 3B:
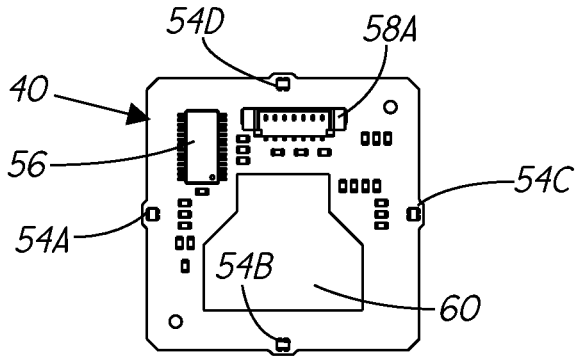
Figure 4A:
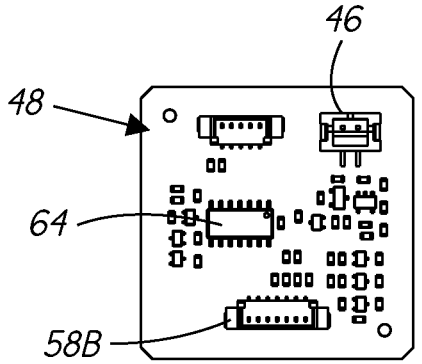
FIGS. 4A and 4B show both sides of the base PCBA of the puzzle device of FIG. 1A with assembled parts labeled.
Figure 4B:
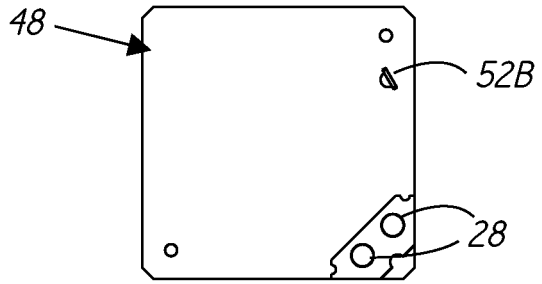
Figure 5:
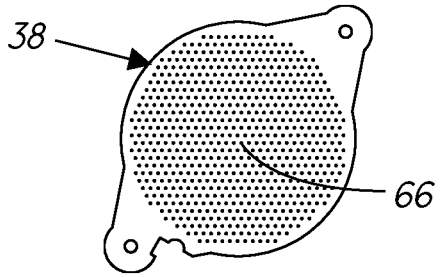
FIG. 5 shows one of the edge-lit panels mounted on the four sides of the puzzle device of FIG. 1A.
Figure 6:
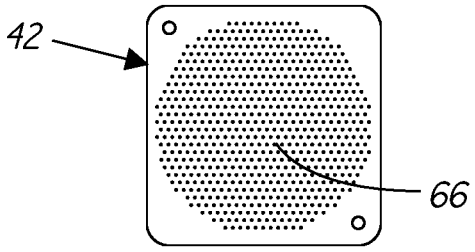
FIG. 6 shows one of the edge-lit panels mounted on the top and bottom of the puzzle device of FIG. 1A.

FIG. 2 shows an exploded view of game device 20. Internally, game device 20 contains a base printed circuit board assembly (PCBA) 48 which has soldered to its top side (shown in detail in FIG. 4A):

- a microcontroller (MCU) integrated circuit (IC) 64;
- a 2-pin 2 mm pitch PCB header for rechargeable battery 46; and
- a 7-pin 1.25 mm pitch PCB header 58B, and soldered to its bottom side (shown in detail in FIG. 4B):

- target disc contacts 28; and
- a side-view multi-color LED 52B (to light base face 22).

Referring again to FIG. 2, a lithium polymer (LiPo) rechargeable battery assembly 45 consists of a lithium-polymer (LiPo) rechargeable battery 47 and a 2-pin 2 mm pitch harness with connector on one side 49. Base PCBA 48 is connected to battery assembly 45 by harness 49 plugging into header 46.

A top printed circuit board assembly (PCBA) 40 has soldered to its top side (shown in detail in FIG. 3A):

- A side-view multi-color LED 52A (to light top face 30), and soldered to its bottom side (shown in FIG. 3B):

- top-view multi-color LEDs 54A through 54D (to light side faces 24, 26, 32, and 34);
- an LED driver integrated circuit (IC) 56;
- a 7-pin 1.25 mm pitch PCB header 58A for connecting base PCBA 48 to top PCBA 40; and
- an accelerometer PCBA 60.

Referring again to FIG. 2., clear panels with etching for edge-lighting of side faces 42A through 42D (detail view in FIG. 6) are assembled by flat-head screws (not pictured) to an inner mounting frame 44.

Laid inside an outer sleeve of cube structure 50 in this order are then:

- A clear panel with etching for edge-lighting of bottom face 38B (detail view in FIG. 5);
- base PCBA 48; and
- inner mounting frame 44 with clear panels 42A through 42D assembled to it.

Outer sleeve 50 is then screwed into inner frame 44 by screws (not pictured) sandwiching base PCBA 48 and clear panel 38B between them.

To complete the internal wiring, one side of a 7-pin 1.25 mm pitch harness with connector on two sides 41 is plugged into header 58B on base PCBA 48, and battery assembly 45 is connected to base PCBA 48, header 46 by harness 49. Harness 41 is then connected to header 58A of top PCBA 40 and laid on top of inner frame 44 such that a box is formed, with battery assembly 45 and harness 41 fully contained inside.

A clear panel with etching for edge-lighting of top face 38A, and an outer lid of cube structure 36 are set atop top PCBA 40. Outer lid 36 is then screwed into inner frame 44 by screws (not pictured) sandwiching top PCBA 40 and clear panel 38A between them, and fully closing the cube structure.

After assembly, side-view LEDs 52A and 52B will be in close proximity to clear panels 38A and 38B respectively, and top-view LEDs 54A through 54D will be in close proximity to clear panels 42A through 42D respectively, such that, through edge-lighting, a circular etched pattern 66 (see FIGS. 5 and 6) may be lit up effectively and individually for each face of the cube, but the area outside these etched patterns is well masked by outer sleeve 50 and lid 36.

Figure 7A:
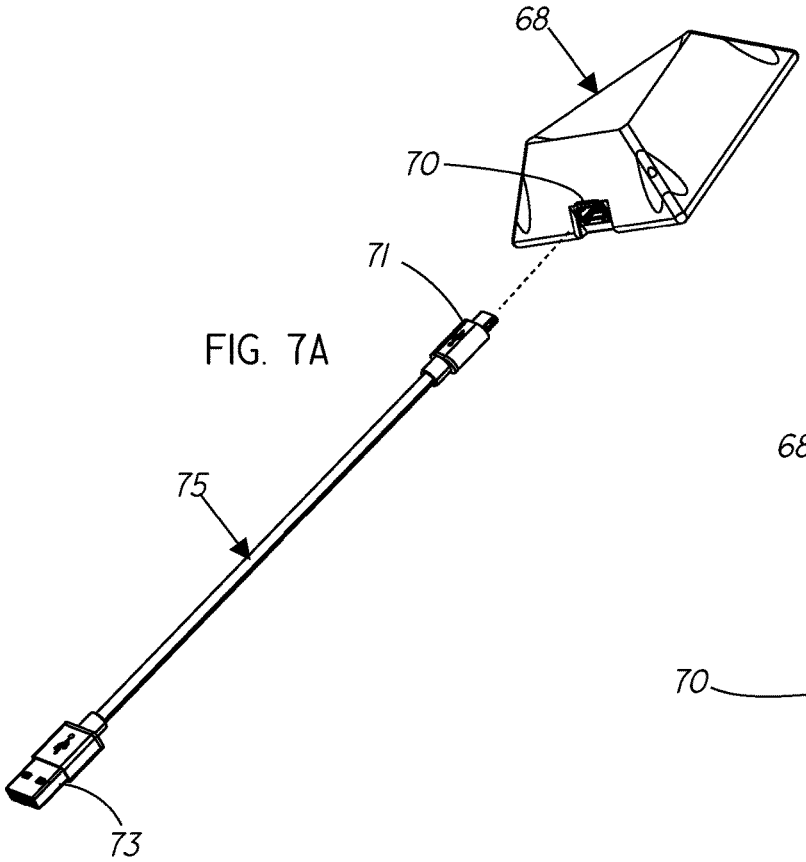
FIG. 7A shows a perspective view of one embodiment of a charging base, used to recharge the battery of the puzzle device of FIG. 1A.
Figure 7B:
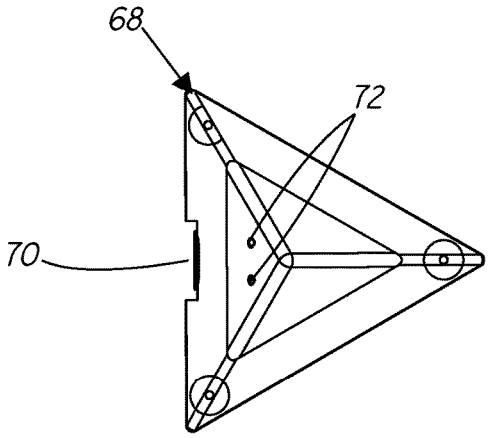
FIG. 7B shows an additional perspective view of the charging base of FIG. 7A.
Figure 8:
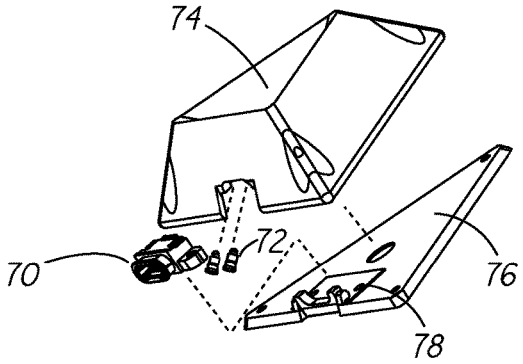
FIG. 8 shows an exploded view of the charging base of FIG. 7A.
Figure 9:
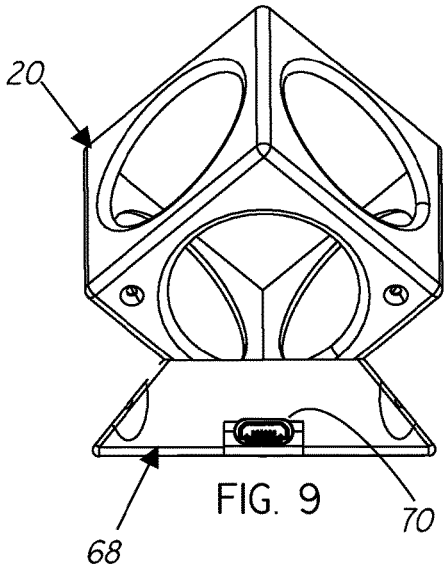
FIG. 9 shows the puzzle device of FIG. 1A seated inside the charging base of FIG. 7A during charging.

Charging and Display Base—FIGS. 7-9

One embodiment of a charging and display base 68 for the game device 20 as assembled is shown in perspective view FIG. 7A and top view 7B. Charging and display base 68 externally presents a USB-B Micro connector power inlet 70 and pogo-pin contacts for charging 72. Power is provided by a USB-A to micro B cable assembly 75, whose USB-B Micro end 71 end is plugged to power inlet 70, and whose USB-A end 73 is plugged to a standard USB wall charger (not pictured).

FIG. 8 shows an exploded view of the charging and display base 68. Pogo-pin contacts 72 are inserted into a top housing 74. They are connected by wire and solder (not pictured) to power inlet 70. Power inlet 70 is then attached by flat-head screws and nuts (not pictured) to the USB-B micro connector mounting area 78 of base plate 76. This base plate 76 is then affixed by screws (not pictured) to the top housing 74 to form the complete charging and display base.

The method of recharging the device's battery is depicted in FIG. 9. The game device 20 is placed on a corner into charging and display base 68, such that pogo-pin contacts 72 make an electrical connection with target disc contacts 28 (see FIG. 1A), thus charging the device with power supplied by connected USB cable 75.

Figure 10:
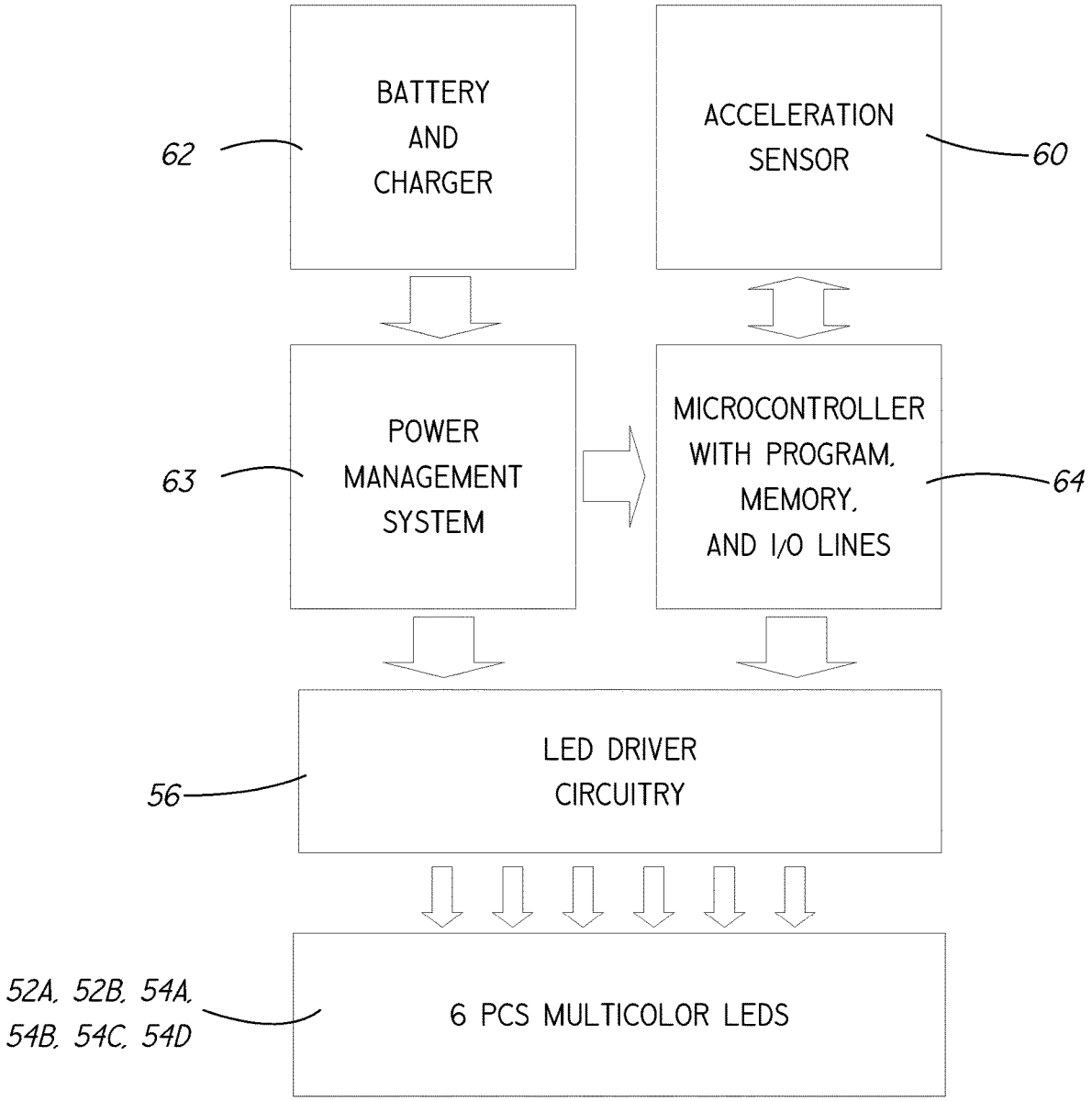
FIG. 10 is a block diagram of the electrical hardware of the device of FIG. 1A.

Overall Electronic Function—FIG. 10

FIG. 10 depicts one embodiment of the overall system electronic function. The operation of side-view multi-color LEDs 52A and 52B and top-view multi-color LEDs 54A through 54D is controlled by a microcontroller (MCU) 64, part number ATtiny1604-SS (Microchip Technology Inc.). Microcontroller (MCU) 64 contains flash program memory, static ram data memory, input/output lines, and various onboard peripherals. Due to its low 3.0V operating voltage and limited number of input/output lines, MCU 64 is unable to drive the LEDs 52A, 52B, and 54A through 54D directly, so additional LED driver circuitry is also provided for. This driver circuitry consists of a dedicated LED driving IC 56, part number PCA9635PW,118 (NXP Semiconductors), as well as common transistor switch circuits, well known in the art, driven directly by the MCU 64. Communication between MCU 64 and LED driving IC 56 is performed through an Inter-Integrated Circuit ($I^2C$) serial interface (NXP Semiconductors). LEDs 52A, 52B, and 54A through 54D are all of a multi-color type, with Red, Green, and Blue (RGB) color LEDs combined together in a single package. As is common in the art, by varying the average current through the individual color LEDs, a full spectrum of colors and full range of intensities can be output based on the control signals of the MCU 64. Also as is common in the art, the individual average LED currents are varied by Pulse Width Modulation (PWM), with PWM drive signals coming from both the LED driving IC 56 and MCU 64.

In this embodiment, the device's tap and gesture interfaces are realized through an acceleration sensor, in this case an accelerometer IC (not shown), part number KX023-1025 (KIONIX, Inc.) soldered to a daughter PCB, forming the accelerometer PCBA 60. Communication between MCU 64 and accelerometer PCBA 60 is performed through an Inter-Integrated Circuit ($I^2C$) serial interface (NXP Semiconductors) as well as via a single digital signal (1 or 0). Gesture and tap recognition is performed within the accelerometer IC on the accelerometer PCBA 60. A tap recognition event recognizes the main axis of the tap (X, Y, or Z) with direction (+ or −), as well as whether the event was a single-tap or double-tap (two taps in fast succession). The accelerometer PCBA 60 will report such a tap event to the MCU 64 over $I^2C$ when the side of the game device 20 is tapped with a part of the body (such as a finger) or other object. The accelerometer PCBA 60 also reports events to the MCU 64 for a significant motion gesture. The accelerometer PCBA 60 will report such a significant motion gesture event to the MCU 64 as a digital signal (1 or 0) when the acceleration on any axis of the game device 20 exceeds a preset threshold. Examples of gestures that can generate a significant motion gesture event include clapping game device 20 between two hands, dropping it on something soft (like a pillow), or tossing it in the air and catching it.

A lithium battery and charger system 62, commonplace to those skilled in the art, is also provided. A +5V charging voltage is passed from USB cable 75 through USB power inlet 70 and pogo-pin contacts 72 in charging base 68 and then received in game device 20 through the target discs 28 (see FIGS. 2, 7A, 7B). This +5V is then converted to a constant-current/constant-voltage charging signal for battery 47 (FIG. 2) by a common IC of type "4054", in this specific case part number LP4054H (Low Power Semiconductor Co. Ltd.). This circuit also provides a digital signal to MCU 64 indicating the state of charging, by means of a simple transistor switch circuit well-known to those skilled in the art, so the software may change its behavior when the device is under charging. In addition, a simple power management system 63, again commonplace to those skilled in the art, is provided, to:

- regulate the battery 47 voltage (+4.2V to +3.2V) down to the +3.0V used by the system;
- provide a means, well-known to those skilled in the art, to switch off power to parts of the system through a simple transistor switch for the purpose of power saving; and
- again well-understood by those skilled in the art, provide a divided battery voltage to the MCU 64 to be read by analog-to-digital conversion (ADC), such that the software may change behavior based on the battery state of charge, such as in low or fully-charged battery conditions.

Operation—FIGS. 11A-11E

FIGS. 11A through 11E depict one embodiment of the high-level software function of the device. Though specific reference will not be made to this diagram in the following description of the device's software, periodic reference to this diagram may prove helpful to the reader's understanding.

Figure 11A:
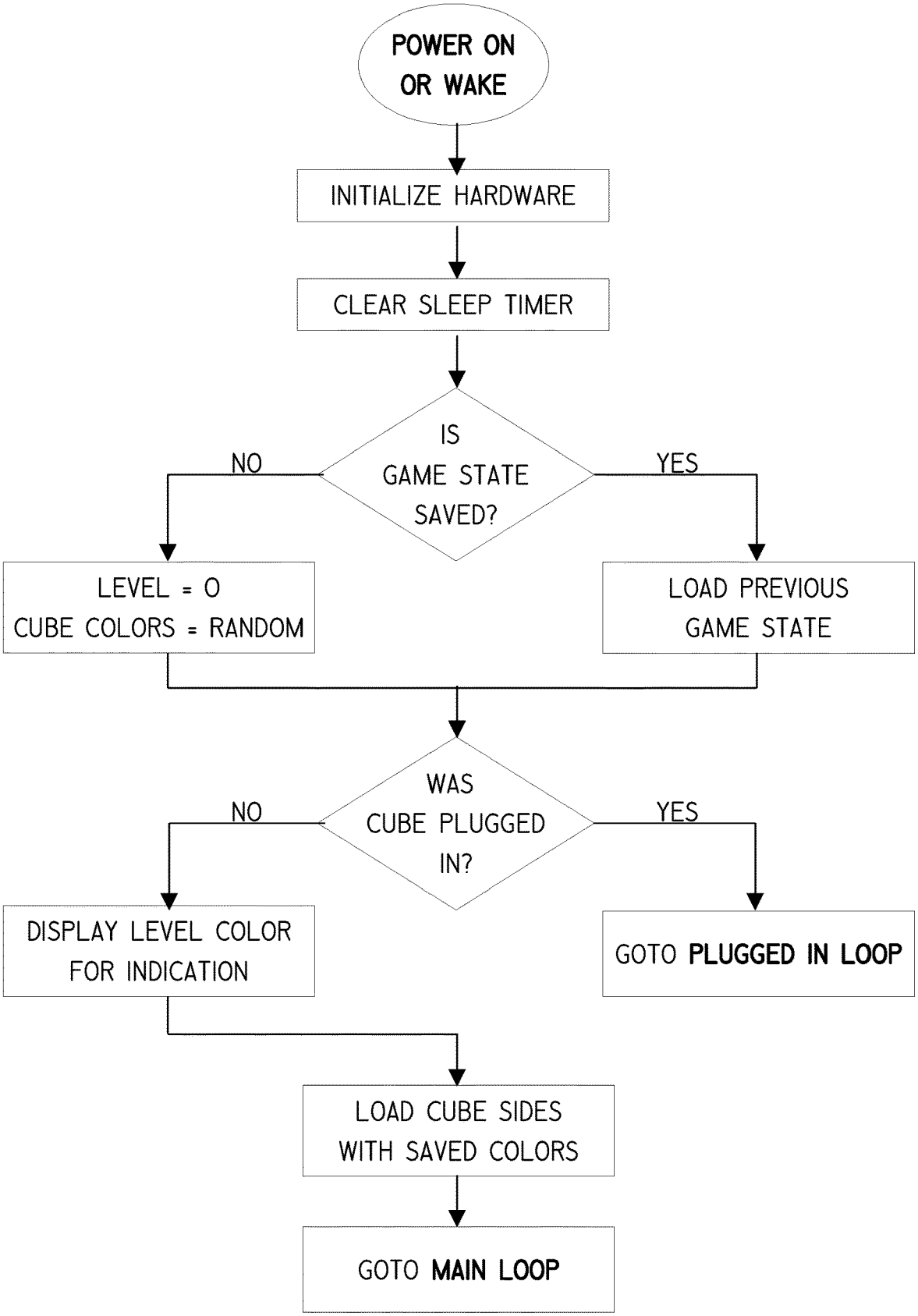
FIG. 11A through 11E comprise a flowchart describing the basic software operation of the device of FIG. 1A.

Power On or Wake—FIG. 11A

FIG. 11A shows the function of game device 20 (FIG. 1) after either powering on or waking from a low-power standby state. Firstly, the system is fully initialized, including:

- initializing the hardware state of the overall system;
- initializing the internal hardware, registers, and memory of MCU 64 (FIG. 10);
- initializing the internal registers of the accelerometer IC of accelerometer PCBA 60 (FIG. 10); and
- initializing the internal registers of LED drive IC 56 (FIG. 10).

Next an internal timer known as the "Sleep Timer" is cleared. The function of the "Sleep Timer" is to put the system into a low-power and battery-saving "Sleep" mode if no user input is detected during the time period measured by the timer. After this, the game's previous state (if any), including current game level and colors of the game sides 22, 24, 26, 30, 32, and 34 (FIG. 1), are loaded from flash memory. If no previous state has been saved, the game is initialized to Level 0, and the colors of the game sides 22, 24, 26, 30, 32, and 34 are randomized. If battery 47 (FIG. 2) is detected to be charging at this point, then game logic proceeds to the "Plugged In Loop" (see FIG. 11C). Otherwise, it next indicates the current game level for the player, through setting the color of all LEDs 52A, 52B, and 54A through 54D (FIG. 10) to a single color and fading them in and out, following this table for indication:

TABLE 1

| Level Indication | |
|---|---|
| COLOR | LEVEL # |
| RED | Level 0 |
| YELLOW | Level 1 |
| GREEN | Level 2 |
| LIGHT BLUE | Level 3 |
| DEEP BLUE | Level 4 |
| PURPLE | Level 5 |
| WHITE | Level 6 |

After the current level is indicated for the player, LEDs 52A, 52B, and 54A through 54D (FIG. 10) are then loaded with the current colors corresponding with the game state and game play begins. Program execution then continues to the "Main Loop" (FIG. 11B)

Figure 11B:
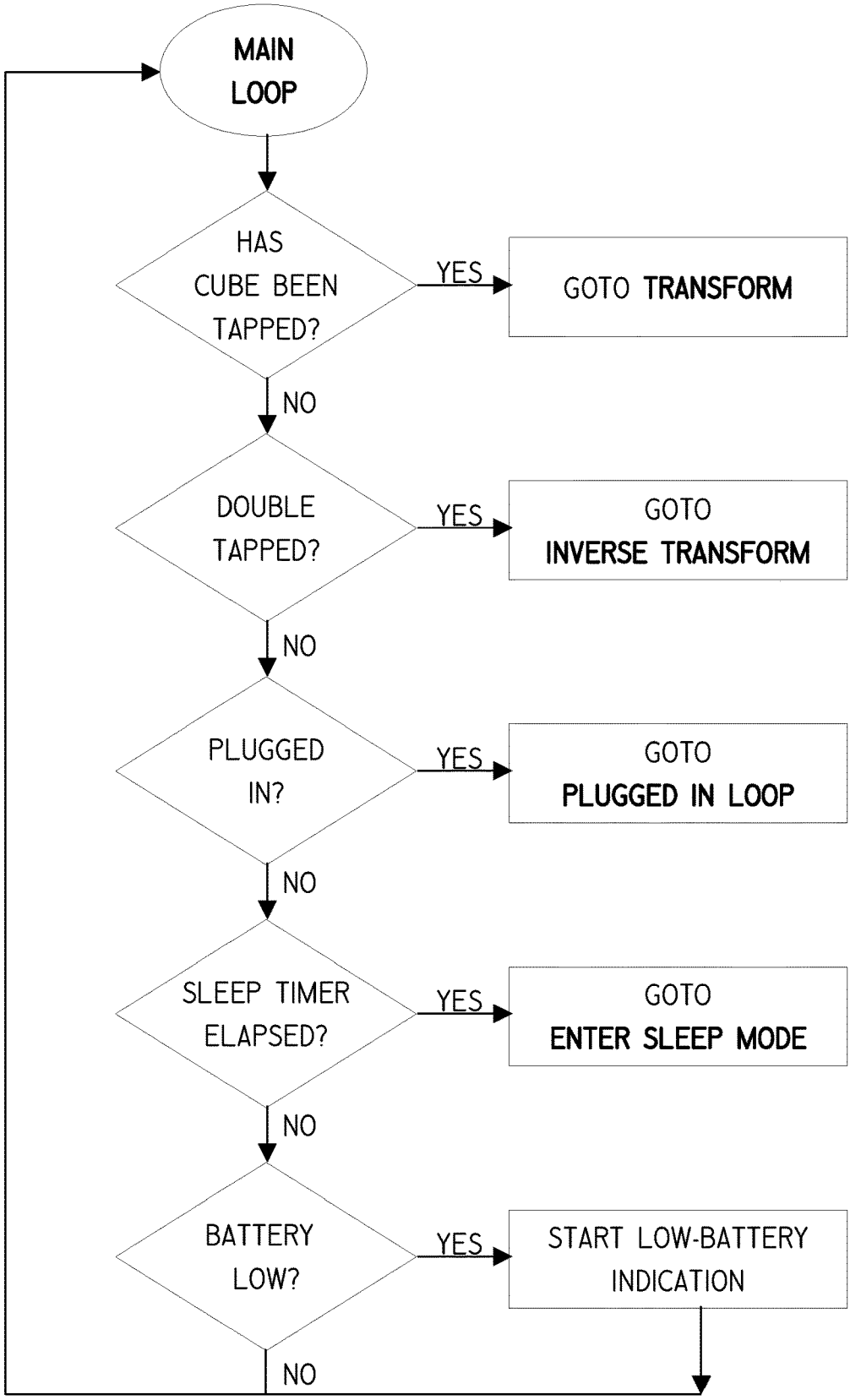

Main Loop—FIG. 11B

FIG. 11B shows the program flow of the "Main Loop" of the software, known to those skilled in the art as the primary logic by which the software operates. Firstly, data from accelerometer PCB 60 (FIG. 10) is read and the data is checked to see if a tap event was recognized. If a single-tap was detected, this means that in an attempt to solve the puzzle, the player has opted to change the state of the sides of the puzzle, and program flow jumps to "Transform" (see FIG. 11D). If a double-tap was detected, the player has elected to "Undo" his or her last move, and the program jumps to "Inverse Transform" (see FIG. 11E).

Next, program operation checks if battery 47 (FIG. 2) is detected to be charging. If so, then game play is paused, and game logic proceeds to the "Plugged In Loop" (see FIG. 11C).

Next, the "Sleep Timer" is checked. The "Sleep Timer" is cleared each time user input (either a tap or charging event) is registered. Thus, if the "Sleep Timer" ever expires, then the system presumes that since the player has not interacted with the game since the "Sleep Timer" was started, game play should be paused at this moment and the system should be put into "Sleep Mode" to preserve the battery level, so program operation proceeds to "Enter Sleep Mode".

Finally, the battery level is checked, by a divided battery voltage to the MCU 64 (FIG. 10) being read by analog-to-digital conversion (ADC). If the battery voltage is determined to be below a fixed threshold, then indication is provided for the player. While in this state, periodically all LEDs 52A, 52B, and 54A through 54D (FIG. 10) will be momentarily flashed in a red color and then back to their normal game state colors. In this way, a low-battery condition may be indicated to the player, but game play is not meaningfully interrupted.

If none of the above state changes are detected in the "Main Loop", then the loop function is executed again.

Figure 11C:
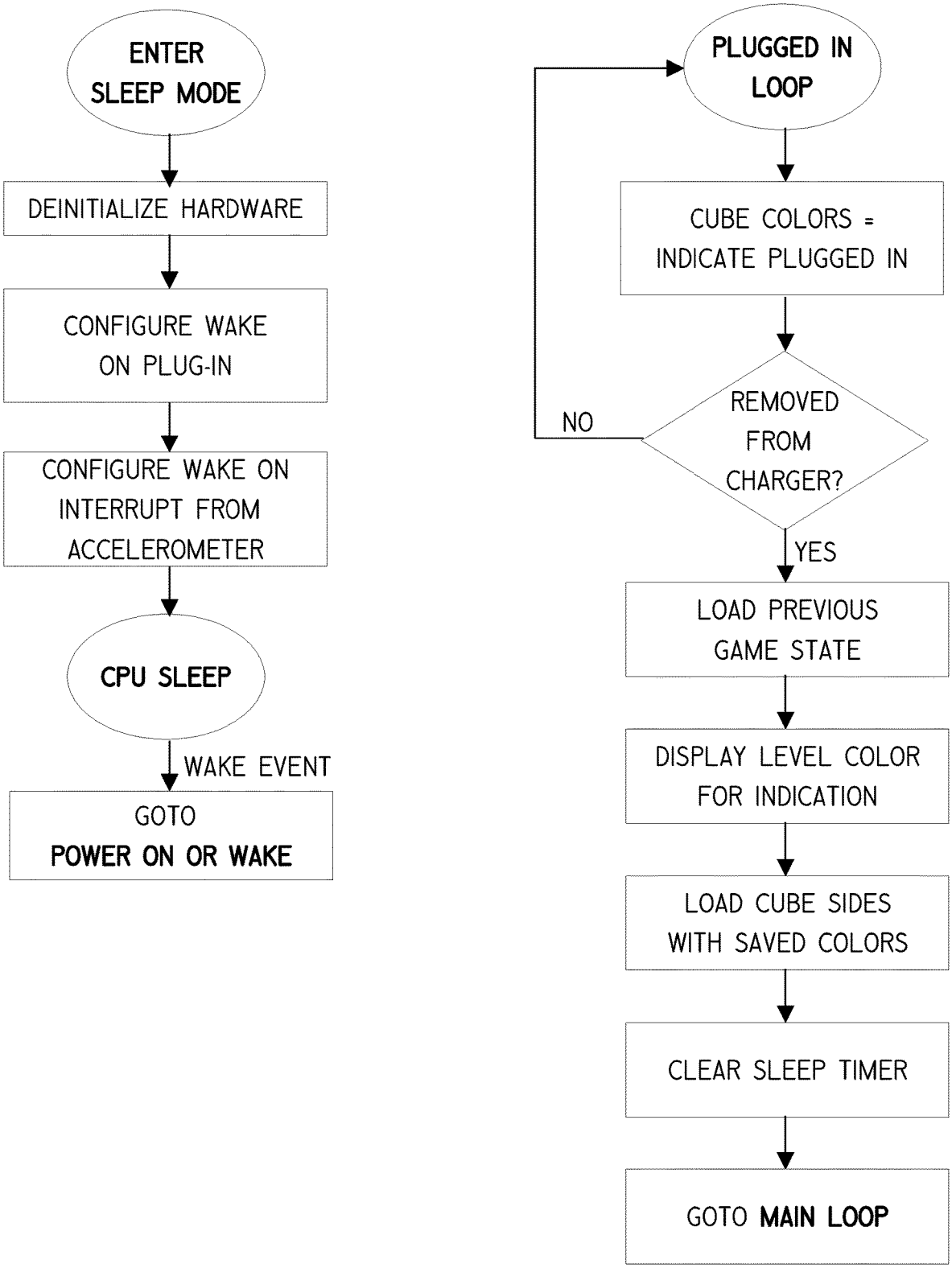

Sleep and Plugged in Functions—FIG. 11C

FIG. 11C describes the "Enter Sleep Mode" and "Plugged In Loop" functions of the software.

As described above, if the player has not interacted with the game in a significant amount of time, game play should be paused and the system should be put into "Sleep Mode" to preserve battery. Function "Enter Sleep Mode" will move the system into the "Sleep Mode" state.

First, all hardware external to MCU 64 (FIG. 10) is deinitialized and moved to a low-power state, including:

- MCU 64 (FIG. 10) switching LED 52B (FIG. 4B) to an off state;
- MCU 64 (FIG. 10) setting the internal registers of LED drive IC 56 (FIG. 10) such that LEDs 52A (FIG. 3A) and 54A through 54D (FIG. 3B) are in an off state;
- MCU 64 (FIG. 10) setting the internal registers of LED drive IC 56 (FIG. 10) such that its internal oscillator is switched off (Sleep mode); and
- powering off other unused hardware in the system.

Next the MCU 64 (FIG. 10) configures itself to exit from "sleep mode" when the battery 47 (FIG. 2) charging state is changed or a digital signal is received from accelerometer PCBA 60 (FIG. 10) in the event of a significant motion gesture. Finally the internal registers of the accelerometer IC of accelerometer PCBA 60 are set to place it into low-power "stand-by" mode, and to output said digital signal to MCU 64 if and when a significant motion gesture occurs.

To enter "sleep mode", the CPU of MCU 64 (FIG. 10) is stopped at "CPU Sleep" (FIG. 11C) to further save power while it waits for a wake-up event from either a significant motion gesture (sensed by accelerometer PCBA 60) or change to battery 47's charging state. When such a wake-up event occurs, program operation continues at "Power On Or Wake" (FIG. 11A).

Also described in FIG. 11C is the "Plugged In Loop"—the behavior of the system while battery 47 (FIG. 2) is under charging. In this mode, LEDs 52A, 52B, and 54A through 54D (FIG. 10) are set to a non-game color (in this embodiment, orange) so that the player can easily see that game play has been paused and the battery 47 is successfully charging. While battery 47 continues to charge, this loop state continues. When game device 20 is finally removed from charging and display base 68, and battery 47 is no longer charging, the game's previous state, including current game level and colors of the game sides 22, 24, 26, 30, 32, and 34, are loaded from memory. Next, as in program section "Power On Or Wake" (FIG. 11A) the current game level is indicated for the player, through setting the color of all LEDs 52A, 52B, and 54A through 54D to a single color and fading them in and out, again following Table 1 for indication. After the current level is indicated for the player, LEDs 52A, 52B, and 54A through 54D are then loaded with the current colors corresponding with the game state. Finally, since a change in charging state is interpreted as user interaction, the above-described "Sleep Timer" is cleared and game-play begins again, with program flow transferring to the "Main Loop" (FIG. 11B).

Figure 11D:
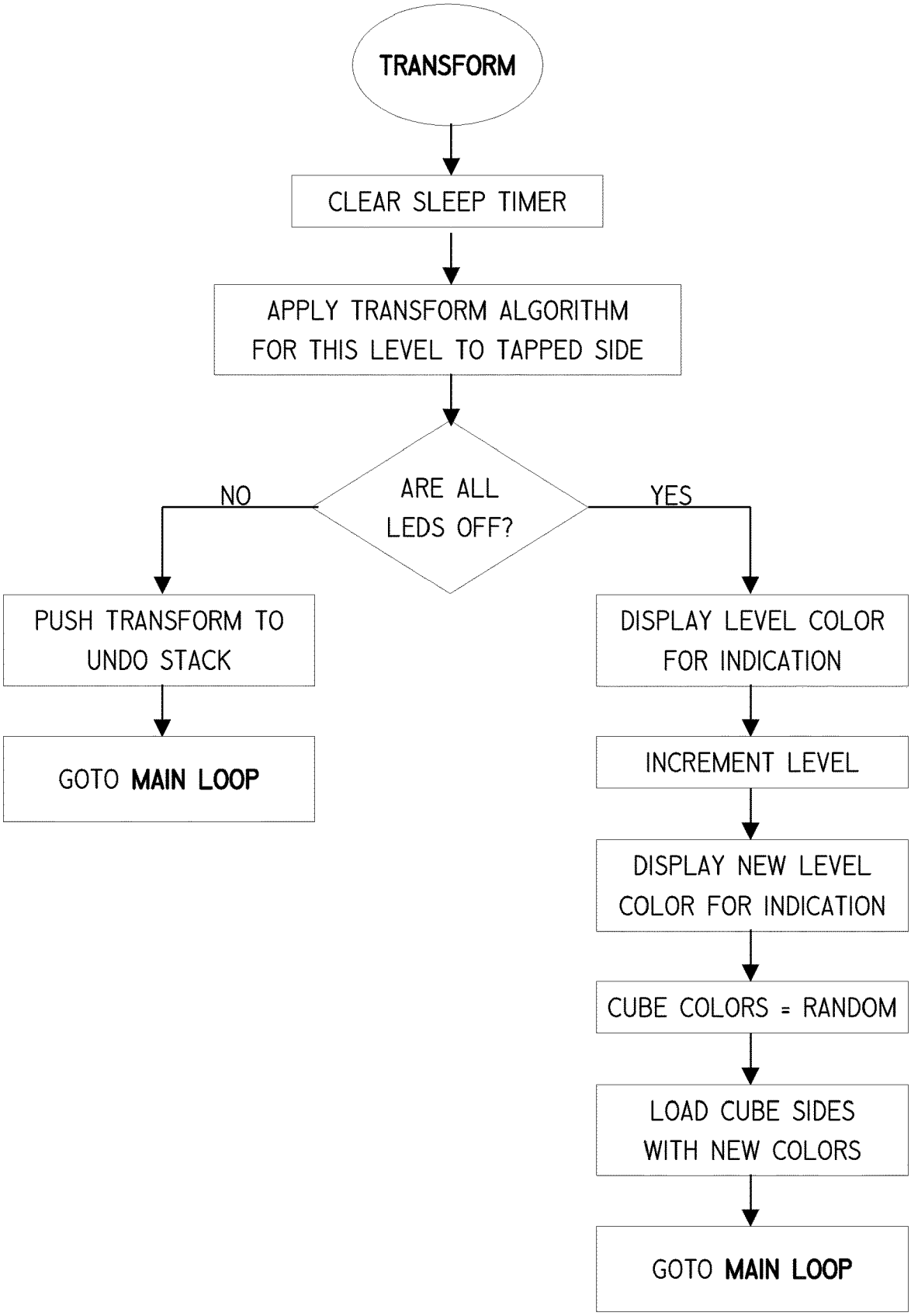

FIG. 11D describes the overall "Transform" function, which is executed when a single-tap on a device side 22, 24, 26, 30, 32, or 34, is detected by accelerometer PCBA 60. In an attempt to solve the puzzle, here the player has opted to change the state of the puzzle sides. Firstly, since a tap event is a user interaction, the above-described "Sleep Timer" is cleared. Secondly, a "Transform" algorithm is applied corresponding to the device side tapped, and the game state is modified accordingly. Finally, the color of the LEDs 52A, 52B, and/or 54A through 54D are updated to present the player with the new game state with which to continue solving the puzzle. The details of the various "Transform" functions possible are not described in FIG. 11D; for more details on the "Transform" algorithms as well as the underlying puzzle and logic problem, see the below section "A Mathematical Description of the Logic Problem".

At this point, after making the transformation, the program checks for the winning condition—in this embodiment that all LEDs 52A, 52B, and 54A through 54D are currently off. If the puzzle is not in the winning state, then the transform is pushed to the "Undo Stack" (see description of the "Inverse Transform" in FIG. 11E below), and program operation proceeds back to the "Main Loop" (FIG. 11B) so that game play may continue.

If the puzzle has been put in the winning state, then a "Level Up" sequence begins whereby game play on the current level is ended and game play on the next level begins. The "Level Up" sequence begins by first indicating the current (and just recently completed) level through setting the color of all LEDs 52A, 54B, and 54A through 54D to a single color and fading them in and out, again following Table 1 for indication. The level is then internally incremented. If the last level (in the described embodiment, this is Level 6) is competed, then the level is instead reset for the player back to level 0. The new level is then indicated in the same way through setting the color of all LEDs 52A, 52B, and 54A through 54D to the new level color and fading them in and out, again following Table 1 for indication, to clearly show the level change for the player. The game state and corresponding colors of each LED 52A, 52B, and 54A through 54D are then randomized, and program operation proceeds back to the "Main Loop" (FIG. 11B) so that game play may continue again on the new level.

Figure 11E:
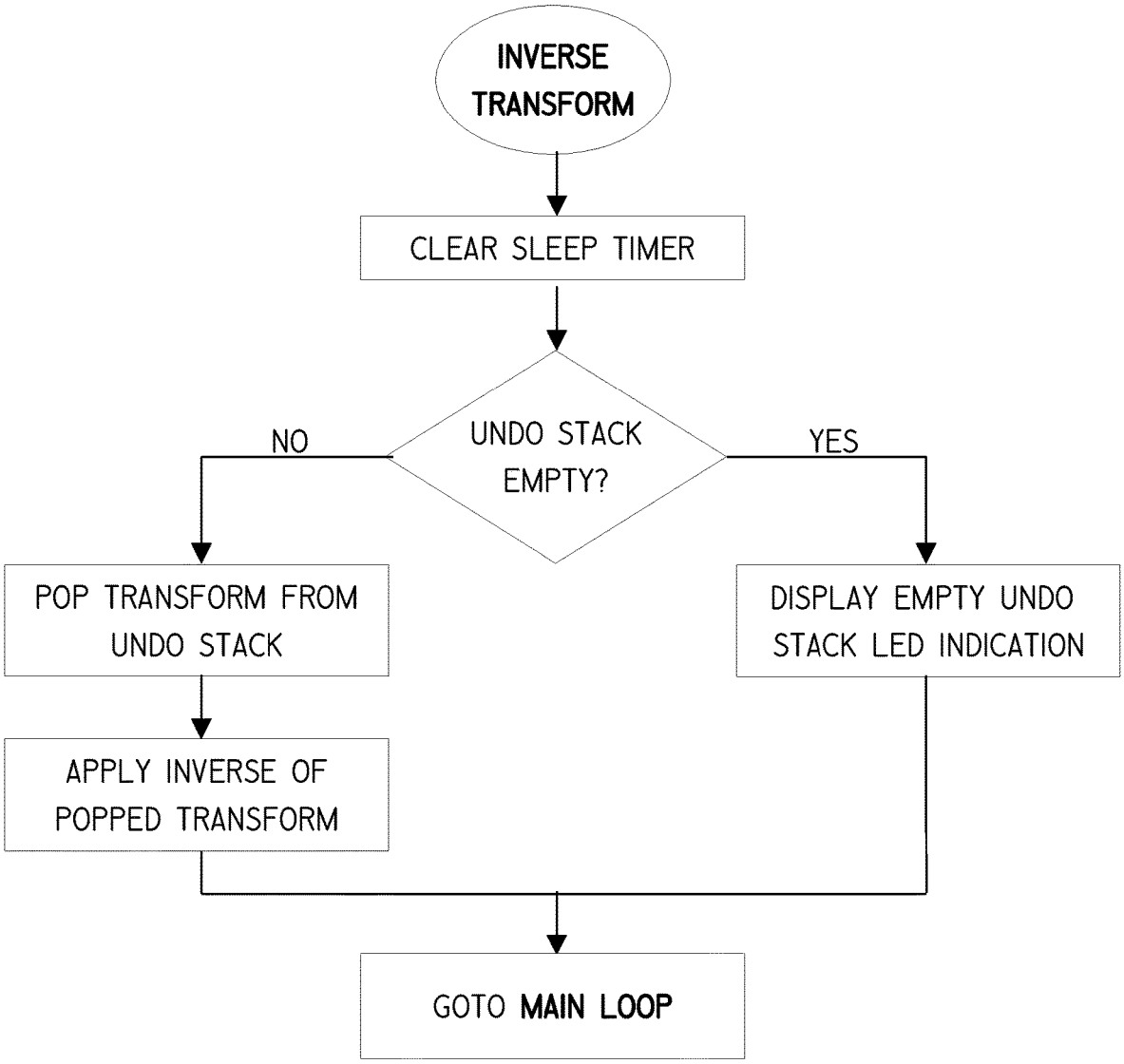

The last diagram of program flow, FIG. 11E, describes the "Inverse Transform" function of the software. In more common terms, this represents the "Undo" function for the puzzle. The operation of an "Undo" function and "Undo Stack" should be clear to those skilled in the art, so just the device-specific details will be elaborated on below. If a player either intentionally or accidentally makes an undesired change to the game state, then this feature may be employed to return the game to the previous desired state, within the memory constraints of MCU 64.

To employ this "Undo" function and enter the "Inverse Transform" function, the player double-taps on any device side 22, 24, 26, 30, 32, or 34 (see "Main Loop", FIG. 11B). Note, unlike the "Transform" function (FIG. 11D), the actual device side which was double-tapped is not an input to the "Inverse Transform" function.

The operation of "Inverse Transform" is as follows. First, since a double-tap event is a user interaction, the above-described "Sleep Timer" is cleared. Secondly, the data in the "Undo Stack" is checked. Note again that each non-winning game state change by single-tap on a device side 22, 24, 26, 30, 32, or 34 is pushed to an "Undo Stack" ("Transform" function, FIG. 11D). If the "Undo Stack" is empty, then the player either has yet to perform a "Transform" (FIG. 11D) or has already undone all previously stored moves, i.e. there is nothing left to "Undo". If such an empty "Undo Stack" condition is reached, then indication is provided for the player—all LEDs 52A, 52B, and 54A through 54D will be momentarily flashed a single time in a yellow color and then revert back to their normal game state colors. By this way, the empty "Undo Stack" condition may be indicated to the player, but game play is not meaningfully interrupted, with program flow returning again to the "Main Loop" (FIG. 11B).

If the "Undo Stack" is non-empty, then the "Undo" operation is performed. "Transform" operations are "pushed" to the undo stack (FIG. 11D) in a typical manner a stack data structure, that is "last in, first out" (LIFO). Thus the "Transform" that is "popped" from the undo stack will be the last one the player applied. After being "popped" from the stack, the "Transform" is then inverted to form an "Inverse Transform", such that applying such an "Inverse Transform" will "Undo" the previous applied "Transform". This "Inverse Transform" is then applied to the game, returning it to its previous state. For more details of the exact "Transforms" and "Inverse Transforms" of this embodiment, see the "Mathematical Description of the Logic Problem" section below. After the "Undo" is completed, game play continues as before, with program flow returning again to the "Main Loop" (FIG. 11B).

Mathematical Description of the Logic Problem

To better illustrate the puzzle's logic problem, one embodiment is described below in detail.

In order to effectively solve the puzzle, the faces of the game device 20 are best understood by the player as N digits of a modulo-M number, where N is the number of faces of the puzzle, and M is the number of colors displayable on each face.

Thus, in FIGS. 1A and 1B, the N=6 sides of the game translated to digit place are as follows in Table 2:

TABLE 2

Game side and corresponding digit

| GAME FACE | DIGIT |
|---|---|
| base face 22 | 0 |
| side face 24 | 1 |
| side face 26 | 2 |
| top face 30 | 3 |
| side face 32 | 4 |
| side face 34 | 5 |

To the casual user, this correlation is not easily deduced, but experienced players of the game will understand well that digit 0 (base face 22) is easily recognized as the side of game device 20 with charging contacts 28. Then, holding the puzzle so that the contacts 28 are in the upper right corner of face 22, the cube may be rotated repeatedly up, right, up, right, up, and right, to cycle through the digits from 0 to 5 and back to 0. In other words, each rotation will present the face of an increasing digit place to the user, in the order listed in Table 2, finally ending up again at base face 22 (digit 0). Note this rotational pattern which correlates digits to game faces is arbitrary, and alternative patterns are clearly possible, but an easily remembered pattern for the player may speed up mastery of the game.

In an additional layer of abstraction, the color of each game face 22, 24, 26, 30, 32, and 34 as illuminated by LEDs 52A, 52B, and 54A through 54D should be considered by the experienced player as the value of each aforementioned digit, as follows in Table 3:

TABLE 3

Color and corresponding digit value

| COLOR | DIGIT VALUE |
|---|---|
| BLACK (OFF) | 0 |
| RED | 1 |
| YELLOW | 2 |
| GREEN | 3 |
| LIGHT BLUE | 4 |
| DEEP BLUE | 5 |
| PURPLE | 6 |
| WHITE | 7 |

Thus, considering the puzzle as shown in FIGS. 1A and 1B and the eight possible colors as listed in Table 3, the state of the entire puzzle can, at any given moment, be thought of as a 6-digit octal (that is, base-8) number. This particular correlation of colors to digit values is also arbitrary, and alternative colors/sequences are of course possible, noting that a sequence easily remembered by the player (such as in this case the order of colors in the spectrum), may speed mastery of the game.

To better illustrate the above, consider the following game state in Table 4:

TABLE 4

Example cube state represented as 6-digit octal number

| GAME FACE | DIGIT | COLOR | DIGIT VALUE |
|---|---|---|---|
| base face 22 | 0 | LIGHT BLUE | 4 |
| side face 24 | 1 | WHITE | 7 |
| side face 26 | 2 | BLACK (OFF) | 0 |
| top face 30 | 3 | YELLOW | 1 |
| side face 32 | 4 | YELLOW | 1 |
| side face 34 | 5 | PURPLE | 6 |

When game device 20 is in this state, it can be considered to have the octal value 611074.

Now that the puzzle's abstraction layer has been explained completely, its game state may just simply be referred to by a 6-digit octal number to simplify the mathematical explanation. The entire puzzle's game state will be additionally abbreviated as x.

It should be clear now, that the check for the puzzle's winning state "Are all lights off?" (FIG. 11D) is actually a check if the puzzle's state x is equal to octal value 000000. The "Transform Algorithm" as referenced in FIG. 11D then may be considered as a function, taking as inputs the current puzzle state x, and game face/digit n (from 0 to 5, see Table 2) that the player has tapped, and represented as f(x, n).

Consider then a simple "Transform" function, adding 1 to the digit that the player has tapped. Mathematically, this may be expressed as:

$$f(x, n)=x+000010^{n}$$

Or to be stated in array notation that may be more familiar to software engineers: let a row vector $a=(a_0\ a_1 \ldots a_5)$ be set as $$a=(000001\ 000010\ 000100\ 001000\ 010000\ 100000)$$

then the "Transform" function can be more simply stated as:

$$f(x, n)=x+a_n$$

Such a "Transform" function could potentially lead to the following sequence of game states in Table 5:

TABLE 5

Example play sequence for "Transform" f(x, n) = x + $a_n$

| TAPPED FACE | GAME STATE |
|---|---|
| (Initial State) | 577767 |
| 1 | 577777 |
| 5 | 677777 |
| 5 | 777777 |
| 0 | 000000 (winning) |

Note from Table 5 that the final tap to face 0 employs a feature of arithmetic that is another game mechanic, namely the idea of a carry. The reader will know well that 9+1=10 and 999,999+1=1,000,000 in base-10 arithmetic. Then similarly in the base-8 arithmetic of the game, 777777+000001=1000000. But since from FIGS. 1A and 1B, game device 20 has 6 faces 22, 24, 26, 30, 32, and 34, then just the six least-significant digits 000000 can be displayed, which, in this example, is the winning state of the puzzle. Thus it too becomes clear how the skilled player of the game may well understand the relationship of game side to corresponding digit as shown in Table 2. Referring to the final transition from 777777 to 000000, side face 34 (digit 5) of the puzzle can be considered to have the unique behavior that it has no carry, a characteristic employed to win the game level described by the above "Transform" function.

Also, in the above example illustrated in Table 5, the usage of a carry is assumed, but depending on the intended game rules, it can actually be seen as an optional part of the "Transform" as will be seen below in further illustrations. Therefore, a clearer representation of the "Transform" function should be to note the carry C in the function as well, such as:

$$f(x, n)=x+a_n+C$$

Further, where it may suit the challenge of a game level to do so, it is not required that C follow standard mathematical rules. A standard mathematical carry of a digit d is always into digit d+1. For example, in the octal operation 000070+000010, the carry from the overflow of digit 1 should be placed in digit 1+1=2, giving the result 000100. But for the purposes of the game, a carry can be made into any digit. Therefore, to note the carry behavior, subscript notation of the digit to apply it to shall be used. A standard mathematical carry left will be noted as $C_{d+1}$, and the "Transform" function demonstrated in Table 5 would be revised as:

$$f(x, n)=x+a_n+C_{d+1}$$

A reverse carry, i.e., one that carries right instead of left, conversely would be noted as $C_{d-1}$. Repeating the previous example, in the octal operation 000070+000010, the reverse carry $C_{d-1}$ from the overflow of digit 1 should be placed in digit 1−1=0, giving instead the result 000001.

The "Inverse Transform" (FIG. 11E) or "Undo" function of any "Transform" can now be also seen to be simply the mathematical inverse of the "Transform". For example, considering the above "Transform" described again as:

$$a=(000001\ 000010\ 000100\ 001000\ 010000\ 100000)$$

$$f(x, n)=x+a_n+C_{d+1}$$

The "Inverse Transform" can then be clearly seen to be:

$$f(x, n)=x-a_n-C_{d+1}$$

Note that carry $C_{d+1}$ in the case of subtraction is more commonly known as a "borrow", and functions in the inverse way. For example when 1 is subtracted from digit value 0 a borrow is invoked.

Table 6 shows how this "Inverse Transform" performs an "undo" of a portion of the previous sequence of Table 5:

TABLE 6

Example undo sequence using "Inverse Transform" f(x, n) = x − $a_n$ − $C_{d+1}$

| PREVIOUSLY TAPPED FACE | GAME STATE |
|---|---|
| (Initial State) | 777777 |
| 5 | 677777 |
| 5 | 577777 |
| 1 | 577767 |

Note how in Table 6 performing the "Inverse Transform" (for example with a double-tap on the device, see FIG. 11B) to the same sides in reverse order of Table 5 shows how the game is able to move back to its initial state of 577767 in Table 5.

Finally, now the concept of incrementing or otherwise changing the game "Level" as described in FIG. 11D can be easily explained as just simply changing the "Transform" and corresponding "Inverse Transform" functions, thereby changing the strategy a player may use to solve the puzzle.

In Table 7, find "Transform" functions for seven example levels:

TABLE 7

"Transform" functions for seven example levels

| LEVEL | ARRAY | $a_0$ | $a_1$ | $a_2$ | $a_3$ | $a_4$ | $a_5$ | "Transform" | Carry |
|---|---|---|---|---|---|---|---|---|---|
| 0 | a | 000001 | 000010 | 000100 | 001000 | 010000 | 100000 | $x + a_n + C_{d+1}$ | Yes |
| 1 | a | 000001 | 000010 | 000100 | 001000 | 010000 | 100000 | $(x + a_n + C_{d+1}) - a_{n-1}$ | $+a_n$ only |
| 2 | a | 000001 | 000010 | 000100 | 001000 | 010000 | 100000 | $(x + a_n + C_{d-1}) + b_n$ | $a_n$ only, |
| | b | 000020 | 000200 | 002000 | 020000 | 200000 | 000002 | | to d-1 |
| 3 | a | 000001 | 000010 | 000100 | 001000 | 010000 | 100000 | $(x + a_n + C_{d+1}) -$ | Yes + |

TABLE 7-continued

"Transform" functions for seven example levels

| LEVEL | ARRAY | $a_0$ | $a_1$ | $a_2$ | $a_3$ | $a_4$ | $a_5$ | "Transform" | Carry |
|---|---|---|---|---|---|---|---|---|---|
| 4 | a | 000002 | 000020 | 000200 | 002000 | 020000 | 200000 | $a_{n-1} - C_{d+1}$ $(x + a_n + C_{d-1}) + (b_n + C_{d-1})$ | and – Both to digit d-1 |
| | b | 100000 | 000001 | 000010 | 000000 | 001000 | 010000 | | |
| 5 | a | 000001 | 000010 | 000100 | 001000 | 010000 | 100000 | $x + a_n + b_n$ | None |
| | b | 000020 | 000200 | 002000 | 020000 | 200000 | 000002 | | |
| 6 | a | 100000 | 000001 | 000010 | 000100 | 001000 | 010000 | $(x + a_n + C_{d+1}) + (b_n + C_{d+1}) + (c_n + C_{d+1})$ | Yes |
| | b | 000002 | 000020 | 000200 | 002000 | 020000 | 200000 | | |
| | c | 000030 | 000300 | 003000 | 030000 | 300000 | 000003 | | |

It should be noted that the above "Transform" functions Table 7 will all be solvable for all states of the game, but this is not guaranteed. Take for example simple "Transform" function $$a=(000002\ 000020\ 000200\ 002000\ 020000\ 200000)$$

$$f(x, n)=x+a_n$$

Clearly this function cannot mathematically reach state 000000 if any of the digits of the initial state are odd. For this reason, care should be taken when designing "Transform" functions and/or setting the puzzle's initial state to ensure that the puzzle is indeed always solvable.

In summary, the logic problem described above can be summarized as:

- a puzzle which is in a three-dimensional housing of N sides, where N is at least 4;
- a means of visually indicating M states on each of the N sides, where M is greater than 2;
- a means to select one side n of the total N sides;
- a modulo-M arithmetic "Transform" operation to be applied based on the players choice of side n to one or more of the puzzle's N sides; and
- a means of changing the visual indication of the puzzle's state to show the result of the modulo-M arithmetic operation.

Alternative Embodiments

Above I've described my Interactive Electronic Puzzle Game Device one way in specific detail, but many other embodiments and alternative implementations are possible within the scope.

Form Factor

Incidentally, in the above embodiment, in order to define the form factor of the game device 20, a housing presenting as a cube with sides of the game 22, 24, 26, 30, 32, 34 has been depicted in FIGS. 1A, 1B, 2, and 9. However, to those skilled in the art, clearly a cube shape is not required for the puzzle game to be played, and the internal state of the mathematical logic problem is clearly extensible to any number of digits and thus any number of game sides. The game sides may be arranged in virtually any three-dimensional form, including other regular and non-regular polyhedrons with flat surfaces. Spherical, curved, or otherwise non-flat faces are also possible. Additionally, the puzzle need not have the sides of the game arranged in any three-dimensional form; indicators may be placed all on the same plane in a two-dimensional arrangement. For example, the sides may be organized in a row, grid, or other pattern, either on one or both sides of a flat surface, such as a game device in a credit-card-sized form factor.

Input Means

Incidentally, in the above embodiment, in order to define the control means of the game device as used in the software flow shown in FIGS. 11A through 11E, an implementation with accelerometer 60 is described. However, to those skilled in the art, other methods to achieve a similar control interface from a user's perspective are clearly possible, such as some combination of push button switch, vibration switch, gyroscope, inertial measurement unit (IMU), compass/magnetometer, touch sensor, capacitive or resistive touch panel, ball-in-cage orientation switch, photo sensor, microphone, and/or piezo elements.

Additionally tap, double-tap, and significant-motion gestures are described as a control means for the current game play described in FIGS. 11A through 11E. However, clearly other gestures such as shake, roll, more than two taps, tap patterns, Morse code, drop, toss in the air, "drawing" geometric patterns and letters, and any other gestures could be recognized and variably responded to depending on the intended game play. Alternative gestures could also be used to enable multiplayer games, whereby the game device senses when it is passed from one player to another or interacted with by more than one person at a time. Hardware and software to support additional input from the user may clearly also be added as needed, such as adding switches, gyroscope, inertial measurement unit (IMU), compass/magnetometer, touch sensor, capacitive or resistive touch panel, photo sensor, microphone, or piezo elements.

Means of LED lighting

Incidentally, in the above embodiment, in order to define the indicator means of the game device, a specific means of LED indication is described. In Table 3, specific colors are listed, but any equivalency of colors to digit value are possible, as well as the number M of digit values and corresponding colors clearly being variable according to the modulo-M arithmetic used by the game logic, from M=2 (single color LED on/off) and up. The LEDs for indication 52A, 52B, and 54A through 54D also need not be of the specific multi-die RGB (Red-Green-Blue) type as described in the above embodiment. Any other type of multi-die LED (such as Red-Blue, or Orange-Green-Blue) or combination of single or multi-die LEDs used to achieve the color perceived by the user are clearly possible. In addition, in the above embodiment, indication is performed by one LED per side 22, 24, 26, 30, 32, and 34 of the game device, but clearly two or more LEDs per side (optionally LEDs on both top and bottom PCBs lighting each side, for example) can be used for additional light intensity or effect as dictated by the specific application.

Incidentally, in the above embodiment, in order to define the indicator means of the game device, a specific circular etched pattern to be lit up upon edge-lighting panels 66 is depicted and described. However, clearly this is not limited to this specific pattern, and can be virtually any pattern, photographic image, texture (molded or otherwise), printed material, or even an LCD or other controlled display panel. Moreover, an embodiment with one etched panel per side is described, but clearly any number of panels can be included as needed. Such additional panels could be either arranged either next to or on top one another, and could be illuminated by separate LEDs, such that different etched patterns and/or colors may be illuminated and revealed to the user based on which LED is illuminated.

Symbols/Non Color Indication

Incidentally, in the above embodiment, in order to define the indicator means of the game device, a specific means of displaying the N digits of a modulo-M number is described in Table 3, whereby each digit value is represented by a specific color. However, many other means of indicating the numeric state of a digit using LEDs are clearly possible. For example, LEDs may be arranged on one face to symbolically indicate the count using a 7-segment numeric display, discrete LEDs may be arranged in the pattern of the dots on a traditional gaming die, or any other symbolic pattern. Additionally, besides using LEDs, clearly myriad means of indicating a digit value exist in the state of the art, such as LCD displays, OLED displays, the display of a numeric or non-numeric symbol, mechanical indicators, or any combination thereof.

Incidentally, in the above embodiment, in order to define the indicator means of the game device, a specific means of displaying the N digits of a modulo-M number is described as the static illumination of a full face of the game device by LED edge-lighting. Alternatively this indication could clearly also be performed by a single point-source LED or back-lit housing, or could potentially be a glowing logo or symbol, or possibly different means for different sides. Additionally, the indication means clearly need not be static—the M values of a modulo-M digit could clearly be represented by different dynamic patterns, such as a flashing pattern (for example by Morse code), or video or other sequence of images displayed on an electrically controlled display such as an LCD.

Incidentally, in the above embodiment, in order to define the indicator means of the game device, a specific visual means of displaying the N digits of a modulo-M number is described. However, such indicator means clearly need not be visual. The indication means could be auditory, such as by a speaker playing a sound that correlates to a digit's value. Alternatively, the indication means could be by sense of touch, for example a vibration motor or other transducer indicating a digit's state by a pattern or intensity of transduced vibration.

Additional Hardware

Incidentally, in the above embodiment, an electrical hardware system in FIG. 10 as specifically utilized by a software flow shown in FIGS. 11A through 11E, is described. However, clearly additional feedback to the user may be added as needed, such as adding additional lights, speaker/sounds, vibration or other motor, LCD or other display, and/or some further indication of score, elapsed time, or game instructions.

Further, in the above embodiment, a device with the single purpose of a puzzle game is described. However, clearly such a puzzle game could be included as part of some more complex device—for example, an embodiment whereupon solving the puzzle some larger goal is achieved, such as unlocking a lock or other game mode or triggering some mechanical action (such as the opening of a box with a prize or another game inside).

Incidentally, in the above embodiment, a specific means of associating the puzzle game side and corresponding digit in Table 2 is presented. However, options to make this association less abstract may be added such as labeling one or more sides, either directly by its numeric place in the N-digit number or by unique symbol.

Processing

Incidentally, in the above embodiment, one specific means of executing the software flow shown in FIGS. 11A through 11E is described, but clearly many configurations that achieve the same flow are possible, such as:

- the software is described as running on a specific microcontroller 64, but clearly such software could be run on any other type of microprocessor, microcontroller, other state machine locally in the device, or by a remote cloud-based or other network service;
- the gesture recognition is described as being performed internally in the accelerometer PCBA 60, but could be performed by a microprocessor, microcontroller, other state machine locally in the device, or by a remote cloud-based or other network service; and
- the LEDs are described as being controlled by microcontroller 64 and driven by LED drive IC 56 using pulse-width modulation, but any other method of control or driving the LEDs or any other indicator are possible, such as by microprocessor, microcontroller, other state machine locally in the device, or by a remote cloud-based or other network service.

Game Play/Software Extensions

Incidentally, in the above embodiment, a specific software flow shown in FIGS. 11A through 11E is described to play one type of puzzle game using the specific logic problem. However, many modifications and additions are possible. To provide additional game variety, use of this logic problem may be clearly mixed with other game rules and algorithms as needed, such as memory play (like the popular electronic game Simon). Additionally, as described in the above embodiment, in the Main Loop of FIG. 11B, currently the game remains static waiting for input from the user. However, clearly this may easily be modified to add a timer to the game, such that the state of the device changes after some time period has elapsed, or the puzzle should be solved within a certain time period or the level is failed and may be retried. Further, as shown in routine "Power On or Wake" in FIG. 11A, currently the game contains only one saved game state, but this may be easily changed to store more than one saved game state and a means may be added to recall one of many saved game states.

Incidentally, in the above embodiment, a standalone game device is described. However clearly a means of communicating with one or more other secondary electronic devices may be added. Such an additional secondary device could potentially be a smart phone, tablet, PC, or smart watch, and the means of communication could, for example, be any of the following: Wi-Fi, Bluetooth, NFC, infrared, sound, Lo-Ra, or any other wired or wireless connection. Such a communication means could enable further control and/or interactivity via the additional device, provide a method of level selection, update the behavior or levels of the device, recharge the device, save and restore the game state, continue the present physical game state on a software version of the game running on the device, or be used as a conduit for internet connectivity.

Additionally, in the above embodiment, a single player game is described. However the game may be clearly modified to be played by more than one player (i.e. multi-player), such that one device is made to be played by multiple users, or multiple devices can communicate to coordinate together through a communication means as described above. Communication may be achieved either directly (peer-to-peer), through a third device (like a cloud server, smart phone, or hub device dedicated for this purpose), or via a network of devices, playing either cooperatively or competitively.

Variations on the Logic Problem

Incidentally, in the above embodiment, a specific logic problem for the puzzle game device is described, but many variations are clearly possible:

- in Table 7, "Transform" functions for seven example levels are listed, but clearly additional and/or different levels are possible;
- the "Transform" functions detailed in Table 7 are only arithmetic add and subtract, with or without carry, but other similar operations can also easily be utilized to effect the same or different game play, such as multiply, divide, modulo (integer remainder), bitwise NOT, bitwise AND, bitwise OR, bitwise XOR, bitwise left-shift, bitwise right-shift or combinations thereof;
- in Table 7, only one arithmetic "Transform" operation is applied to all sides, but this can easily be revised to allow multiple types of operations per level, optionally being selected by the player through side selection, device orientation, gesture, timer, or other means;

Incidentally, in the above embodiment, the "Transform" functions detailed in Table 7 are arithmetic operations, but may also include logical operations as well, such as:

- a "Transform" function, arithmetic or otherwise, being performed on the game face or faces previously selected, as well as on the currently selected game face;
- a "Transform" function which is logically determined by the states of proximal or other game faces, such as a "Transform" function that changes when a proximal face or faces is in specific numeric state (such as being the same as the currently selected game face) or a specific indication state (such as light off); and
- a "Transform" function which is selected based on the values of some or all game faces, such as a function which does not allow any numeric state to be repeated on more than one game face.

Incidentally, in the above embodiment, the "winning state" goal of the puzzle is specified as "all lights off" (octal value 000000) in FIG. 11D, but could be any target number, color, pattern, or sequence of patterns, including:

- the indication means could be various sections of a 2D or 3D image, with said sections displayed on the puzzle game faces, and the goal might be the condition where the complete 2D or 3D image is shown properly;
- the indication means could be various letters, with the puzzle game faces arranged in such a way where a word or words can be read from the letters, and the goal might be the condition where the letters spell a word or words, either known in advance or unknown to the player;
- the indication means could be various numeric digits (not necessarily corresponding to their underlying arithmetic values in the puzzle logic) with the puzzle game faces arranged in such a way where a multi-digit number can be read from the individual digits, and the goal might be the condition of a specific multi-digit number, either known in advance or unknown to the player;
- the indication means could be various symbols with the puzzle game faces arranged in such a way where a sequence of symbols can be read from the individual symbols, and the goal might be the condition of a specific symbolic sequence or pattern, either known in advance or unknown to the player;
- some combination of images, letters, numbers, or symbols as detailed above; or
- multiple goals may exist—for example, given an indication means of various letters, all primary entries in an English dictionary which are spelled with the displayed letters might be possible "winning states".

Incidentally, in the above embodiment, a specific means of programming the logic problem for the puzzle game device is described, wherein for a given level:

- the puzzle state is held in a single modulo-M number x;
- there is an array of $a_n$ modulo-M numbers;
- there is a carry variable C; and
- there is an arithmetic operation performed by the software on x, $a_n$, and C to calculate the next puzzle state x.

However, to those skilled in the art, clearly the same logic problem and puzzle game may be programmed in software in any number of ways, including using a Finite State Machine (FSM), switch-case statements, if-then statements, object representations of puzzle state, look-up table, etc. Additional processors, memory, or other hardware communicating locally on-device or remotely over a network could also be added for the purpose of transforming the state of the puzzle according to the level rules.

Additionally, software flow as depicted in FIGS. 11A through 11E may be further modified in various ways to enhance the logic problem, game play, and challenge for the player, including:

- a tap or other means of selecting a side as shown in FIG. 11B does not necessarily mandate that the side tapped must change state;
- additional gestures or other input means could provide an alternative means of setting the puzzle state, such randomizing the game faces or setting a game face or faces to a specific indication state, optionally a limited number of times; and
- additional gestures or other input means could provide a way for the game to change state, such as a means to select the game level (FIG. 11D), recall a previously stored game state (FIG. 11A) or "Enter Sleep Mode" (FIG. 11C).

Video Game Embodiments

Incidentally, in the above embodiment, a specific physical hardware device dedicated to playing the puzzle game described is presented. However, as is clear to those skilled in the art, this puzzle game may be easily realized and played as a purely digital version, such as a video game played on a computer, mobile phone, or game console. In such a video game version, the puzzle may be represented onscreen in a two-dimensional or three-dimensional aspect. Input devices common to such video games such as a mouse, touchscreen, or gamepad controller may be used as means of manipulating the puzzle's orientation of configuration onscreen, as well as for as the control means changing the puzzle state.

Additionally, the puzzle game may also be played in a hybrid digital/physical game, such as an augmented reality game or virtual reality game. In such a hybrid digital/physical game, additional means of manipulating the puzzle's orientation and changing its state may include gesture and attitude controls.

In any of the video game embodiments described above, the puzzle may be included as a smaller part of a larger goal, for example as a "mini-game" included inside of a larger video game.

Advantages

From the description above, a number of advantages of some embodiments of my puzzle game device become evident:

- it is novel and challenging;
- it provides a straightforward means to achieve mastery of the puzzle through a player achieving understanding of the underlying logic problem;
- the modulo-M arithmetic operations it uses are efficiently executed by low-cost microprocessors and microcontrollers, leading to lower system cost;
- the modulo-M arithmetic operations it uses provide a challenging logic problem for the player, but are relatively simple for the game designer to implement, providing an easy and efficient way to create virtually unlimited game levels for the player and also giving a means to create additional product versions with entirely new levels but low development effort; and
- allows use of only a single indicator per side and a low number of sides (in the above described, six sides and six indicators) to be challenging for the player, again reducing the complexity and system cost versus multi-indicator-per-side prior art.

Conclusions, Ramifications, and Scope

Accordingly, the reader will see that the puzzle game devices of various embodiments provide a novel challenge to players in an inexpensive configuration. Additionally, the logic problem is easily extensible so that additional products of the same puzzle game may be developed easily. Minor changes such as updating the software to provide additional levels or changing the physical housing to change the configuration, indication means, or number of game sides (and according modulo-M number of N digits), allow providing additional challenge for players with low development effort.

Furthermore, the game puzzle has the additional advantages that:

- it is easily realized in a portable cube-shaped form factor popular among puzzle enthusiasts;
- it may be constructed with materials and assembly steps that enable low-cost manufacturing;
- it allows use of a single acceleration sensor as input means, again providing both material and assembly cost improvements over a puzzle device with a push button or other tactile switch on each face; and
- the ability to create many products in varying configurations using the same puzzle game will allow enthusiasts an opportunity to build a collection of the varying products.

Although the description above contains many specificities, these should not be construed as limiting the scope of the embodiments but as merely providing illustrations of some of several embodiments.

Thus the scope of the embodiments should be determined by the appended claims and their legal equivalents, rather than by the examples given.

I claim:

1. A puzzle device comprising:

(a) a current puzzle state represented by a modulo-M number of N digits;

(b) a set of N indicators each capable of indicating one digit of the current puzzle state;

(c) an array of N arithmetic and/or logical operations with each operation in the array corresponding to one of said set of indicators; and (d) a control means of selecting one of said set of N indicators, whereby when one of said set of N indicators is selected, its corresponding operation in the array of arithmetic and/or logical operations is selected, applied to the current puzzle state's modulo-M number of N digits, and the new current puzzle state indicated by said set of N indicators.

2. A device as in claim 1, wherein said indicators are visual indicators.

3. A device as in claim 2, wherein the numerical digits of said current puzzle state are indicated by a light being on or off.

4. A device as in claim 2, wherein the numerical digits of said current puzzle state are indicated by the color of emitted light.

5. A device as in claim 2, wherein the numerical digits of said current puzzle state are indicated by a symbolic representation.

6. A device as in claim 2, wherein said set of N indicators include an LED.

7. A device as in claim 2, wherein said set of N indicators include an LCD.

8. A device as in claim 1, wherein said set of N indicators are arranged in a three-dimensional configuration.

9. A device as in claim 8, wherein said three-dimensional configuration is a polyhedron.

10. A device as in claim 1, wherein said control means of indicator selection is a switch.

11. A device as in claim 1, wherein said control means of indicator selection is an acceleration sensor.

12. A device as in claim 1, wherein said control means of indicator selection is a touch sensor.

13. A device as in claim 1, further comprising an audible indicator activatable in response to a signal from said control means.

14. A video game system including a control processor for playing a puzzle video game comprising:

(a) a current puzzle state represented by a modulo-M number of N digits;

(b) a set of N indicators each capable of indicating one digit of the current puzzle state;

(c) an array of N arithmetic and/or logical operations with each operation in the array corresponding to one of said set of N indicators; and (d) a control means of selecting one of said set of N indicators, whereby when one of said set of indicators is selected, its corresponding operation in the array of arithmetic and/or logical operations is selected, applied to the current puzzle state's modulo-M number of N digits, and the new current puzzle state indicated by said set of N indicators.

15. A video game system as in claim 14, wherein the numerical digits of said current puzzle state are indicated by color.

16. A video game system as in claim 14, wherein the numerical digits of said current puzzle state are indicated by symbol.

17. A video game system as in claim 14, wherein said set of N indicators are displayed onscreen in a three-dimensional configuration.

18. A video game system as in claim 17, wherein the displayed orientation of said three-dimensional configuration may be manipulated by a pointing interface such as a computer mouse or touchscreen.

19. A video game system as in claim 14, wherein said control means of selecting one of said set of N indicators is by a pointing interface such as a computer mouse or touchscreen.

* * * * *